US011408139B2

(12) United States Patent
Birtele et al.

(10) Patent No.: US 11,408,139 B2
(45) Date of Patent: Aug. 9, 2022

(54) ELONGATED CONNECTING ELEMENT FOR ANCHORING MEMBERS AND METHOD FOR PROVIDING AND INSTALLING AN ELONGATED CONNECTING ELEMENT FOR ANCHORING MEMBERS

(71) Applicant: THUR S.R.L., Verona (IT)

(72) Inventors: Andrea Birtele, Verona (IT); Matteo Gabassi, Mestre (IT)

(73) Assignee: THUR S.R.L., Verona (IT)

( * ) Notice: Subject to any disclaimer, the term of this patent is extended or adjusted under 35 U.S.C. 154(b) by 0 days.

(21) Appl. No.: 16/968,276

(22) PCT Filed: Feb. 4, 2019

(86) PCT No.: PCT/EP2019/052615

§ 371 (c)(1),
(2) Date: Aug. 7, 2020

(87) PCT Pub. No.: WO2019/154754

PCT Pub. Date: Aug. 15, 2019

(65) Prior Publication Data

US 2021/0032829 A1 Feb. 4, 2021

(30) Foreign Application Priority Data

Feb. 7, 2018 (IT) ..... 102018000002456

(51) Int. Cl.
*E02D 5/80* (2006.01)
*E21D 21/00* (2006.01)
*E21D 20/02* (2006.01)

(52) U.S. Cl.
CPC ..... *E02D 5/808* (2013.01); *E21D 20/025* (2013.01); *E21D 21/006* (2016.01);
(Continued)

(58) Field of Classification Search
CPC combination set(s) only.
See application file for complete search history.

(56) References Cited

U.S. PATENT DOCUMENTS

2006/0093438 A1* 5/2006 Fergusson ..... E21D 20/02 405/259.3
2013/0236251 A1* 9/2013 Smith ..... E21D 20/026 405/259.5

(Continued)

FOREIGN PATENT DOCUMENTS

DE 1945493 A1 3/1971
WO 2012113976 A1 8/2012

OTHER PUBLICATIONS

International Search Report dated Feb. 27, 2019 re: Application No. PCT/EP2019/052615, pp. 1-3, citing: WO 2012/113976 A1 and DE 19 45 493 A1.

(Continued)

*Primary Examiner* — Kyle Armstrong
(74) *Attorney, Agent, or Firm* — Cantor Colburn LLP

(57) ABSTRACT

An elongated connecting element for anchoring members, which is provided with a first anchoring end portion designed to be inserted into an anchoring region and a second end portion which defines a head, which lies opposite the first anchoring end portion and is designed to interact with an element to be anchored. The elongated connecting element includes an external tubular element which accommodates an internal elongated body, the external tubular element defining, at the head, at least one feeding port for a synthetic anchoring mix and, at the first anchoring end portion, at least one exit opening for the synthetic anchoring mix. The synthetic anchoring mix is configured to set, penetrating at least partially into the anchoring region and creating a stable connection between the anchoring region (Continued)

and the elongated connecting element and between the respective portions of the external tubular element and of the internal elongated body.

16 Claims, 4 Drawing Sheets

(52) U.S. Cl.
CPC ..... *E21D 21/008* (2013.01); *E21D 21/0033* (2013.01); *E02D 2250/003* (2013.01); *E02D 2300/0004* (2013.01); *E02D 2600/30* (2013.01)

(56) References Cited

U.S. PATENT DOCUMENTS

2015/0322785 A1* 11/2015 Ahola ..... E21D 20/028
405/259.3
2018/0291737 A1* 10/2018 Pastorino ..... E21D 20/02

OTHER PUBLICATIONS

IT Search Report dated Aug. 14, 2018 re: Application No. 2018000002456, pp. 1-8, citing: WO 2012/113976 A1 and DE 19 45 493 A1.
Written Opinion dated Feb. 27, 2019 re: Application No. PCT/EP2019/052615, pp. 1-6, citing: WO 2012/113976 A1 and DE 19 45 493 A1.

* cited by examiner

ELONGATED CONNECTING ELEMENT FOR ANCHORING MEMBERS AND METHOD FOR PROVIDING AND INSTALLING AN ELONGATED CONNECTING ELEMENT FOR ANCHORING MEMBERS

TECHNICAL FIELD

The present disclosure relates to an elongated connecting element, for example constituted by a tension member or by a nail, for anchoring members and a method for providing an elongated connecting element for anchoring members, in particular for uses in the field of construction, for example for control of hydrostatic lift, the stabilization of built structures or slopes, in excavations etc.

BACKGROUND

Nowadays, for the aforementioned uses, anchoring members are employed, such as tension members, anchoring nails, or bolts.

The tension members used in construction are structural elements operating in traction and are adapted to transmit the forces deriving from outside (for example represented by the thrust of a rocky mass or by the surface soil of a slope or even by vertical masonry) to soil volumes that are deeper and more stable. The tension member is made up of the following parts:

- head: an assembly of end elements that are adapted to transmit the traction force of the tension member to the anchored structure or directly to the rock;
- free part: the section of the tension member or of the nail that is not connected to the soil and is therefore free to undergo deformations, thus transmitting the traction force;
- anchoring length: the section of the tension member or of the nail that is constituted by the assembly of elements that are adapted to transmit the traction forces to the surrounding soil, by friction and adherence.

If the free length of the tension member is zero, i.e. its anchoring length corresponds to its overall length, then the tension member is defined as a nail. The purpose of nails is to aggregate volumes of soil or rock that are not separate, or to restore the mechanical functionality of a damaged masonry facing, be it constituted by stone, concrete or brick elements.

Nowadays bar tension members with continuous threading are known and widely used.

These tension members are inserted into a hole that has at least the length of the tension member and which passes through the structure to be consolidated, or the foundation. A first, free end portion is designed to be inserted toward the bottom of the hole and will constitute the anchoring length, and a second end portion, which lies opposite the first end portion, the threaded outer surface of which engages with a contrast body that is integral with the structure to be consolidated and that is referred to as head of the tension member.

A protective sheath is fitted around the threaded bar in a position proximate to the second end portion, and is adapted to provide the free part of the tension member.

In some cases, in a position proximate to the first end portion, there is a spacer body, which makes it possible to maintain the tension member axially aligned with the direction of extension of the hole.

The anchoring of the first end portion to the soil is done by injecting or pouring a binder of the cement type in the liquid state, in general what is known as a grout injection, into the hole (and therefore outside the protective sheath) so that the binder reaches the bottom of the hole in order to then penetrate into the soil and set, adhering to the first, free end portion of the tension member, which constitutes the anchoring length.

Once the binder has set, the tension member can be tensioned by acting on a tensioning head associated with the contrast body.

The solution described above, although widely employed, is not devoid of drawbacks, however.

Firstly, it should be noted that the transverse cross-sections of the bars employed must have a fairly large dimension (of the order of 30-50 mm) and this entails a number of operating problems such as the need to make holes of considerable diameter (and therefore the need to use costly and cumbersome equipment) or the difficulty in having to handle long lengths of rigid bars inside built structures or in areas that are not particularly accommodating.

It should further be noted that the grout employed has rather long setting times and this results in an increase in the time needed to install the anchoring member and tension it, and also the possibility that some of the grout might not remain in the neighborhood of the tension member and instead (if the soil is very porous) become dispersed in soil volumes that are too far from the tension member and are therefore not involved in the strength mechanism.

Construction regulations further require that the tension members be tested to verify that they have the mechanical strength characteristics that were specified at the design stage.

If one of the tension members does not pass the tests, it will be necessary to insert a new tension member in a closer position, repeating the operations described above.

SUMMARY

The aim of the present disclosure is to provide an elongated connecting element for anchoring members which is capable of improving the known art in one or more of the above mentioned aspects.

Within this aim, the disclosure provides an elongated connecting element that has an extremely small cross-section but is at the same time capable of ensuring high strength.

The disclosure further provides an elongated connecting element that is extremely flexible, adapted to be used even in confined spaces, where it is not possible to work with rigid elements and/or using cumbersome machinery.

The disclosure also provides a method for providing and installing an elongated connecting element that is extremely rapid and flexible and which is such that its design suitability can be verified rapidly and simply.

The disclosure provides an elongated connecting element for anchoring members and a method for providing and installing an elongated connecting element that is highly reliable, easy to implement and at low cost.

This aim and these and other advantages which will become better apparent hereinafter are achieved by providing an elongated connecting element for anchoring members and by a method for providing and installing an elongated connecting element according to the claims.

BRIEF DESCRIPTION OF THE DRAWINGS

Further characteristics and advantages of the disclosure will become better apparent from the description of some preferred, but not exclusive, embodiments of the elongated connecting element according to the disclosure, which are illustrated for the purposes of non-limiting example in the accompanying drawings wherein.

DETAILED DESCRIPTION OF THE DRAWINGS

Figure 1:
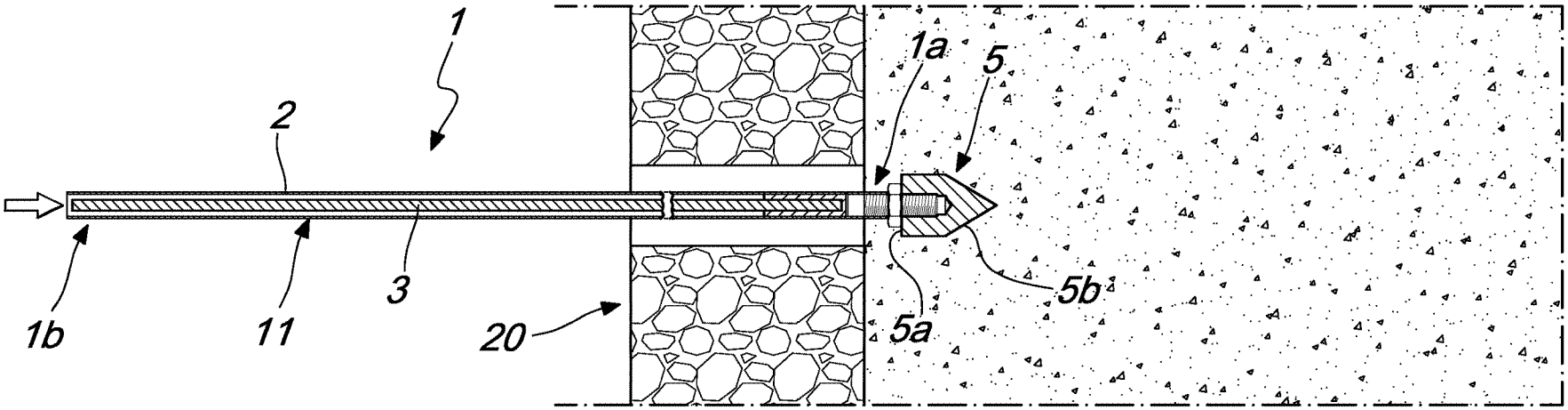
FIG. 1 is a cross-sectional view of the elongated connecting element according to the disclosure during the insertion step.
Figure 2:
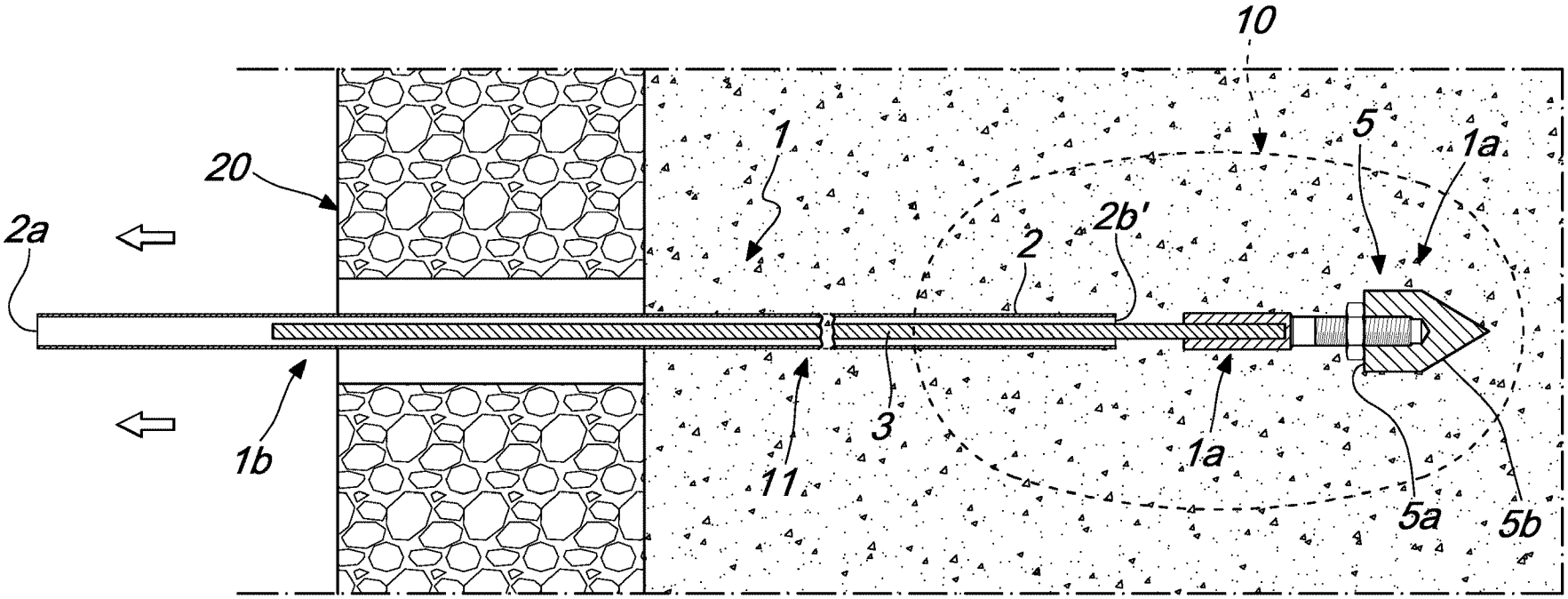
FIG. 2 is a view similar to the previous view of the elongated connecting element in the step following the insertion step, which entails the partial extraction of the external guide tube, once the desired driving depth has been reached.

With reference to the figures, the elongated connecting element for anchoring members according to the disclosure, generally designated by the reference numeral 1, is provided with a first end portion 1*a* (anchoring length) designed to be inserted into an anchoring region 10 and with a second end portion 1*b* which defines a head, which lies opposite the first end portion 1*a*.

The region to be anchored 10 comprises, for example, a volume of soil or a portion of a wall or of a built structure in general.

The second end portion 1*b* is, in particular, designed to interact with an element to be anchored 20.

According to a first practical embodiment, the elongated connecting element 1 comprises a tension member 11 which can be connected, at the respective head, to a supporting element 21 which is connected stably to the element to be anchored 20.

Alternatively, the elongated connecting element 1 comprises a nail which is provided with a head which is stably connected by friction to the element to be anchored.

The element to be anchored 20 can comprise a foundation of a building, a wall to be consolidated, a portion of rocky wall etc.

According to the present disclosure, the elongated connecting element 1 comprises an external tubular element 2 which accommodates an internal elongated body 3.

The external tubular element 2 defines, at the second end portion 1*b* which defines the head, at least one feeding port 2*a* for the introduction of a synthetic anchoring mix 30, which is advantageously constituted by a fluid compound.

The external tubular element 2 is further provided, at the first end portion 1*a* (anchoring length), with at least one exit opening 2*b* for the synthetic anchoring mix 30.

The synthetic anchoring mix 30 is designed to set, penetrating at least partially into the anchoring region 10, providing, furthermore, a stable connection at least between respective portions of the external tubular element 2 and of the internal elongated body 3.

Preferably, the synthetic anchoring mix 30 comprises for example polyurethane resin, urea resin, organic-mineral resin. The use of a synthetic mixture with reduced setting times makes it possible to provide the tension member or the nail in a short time, while at the same time avoiding the dispersion of this synthetic mixture in volumes of soil far from the injection point (even for particularly porous soils). Furthermore, the intrinsic properties of synthetic mixtures (in terms of adhesion and viscosity) determine an increase of the adherence forces at the soil/tension member interface, compared to traditional cement mixtures and for the same surface affected by the tensioning of the tension member.

Advantageously, the internal elongated body 3 comprises a flexible cable.

For the purposes of example, such flexible cable can have an extremely small diameter, of the order of 5-6 mm.

Conveniently, the elongated connecting element 1 comprises a contrast body 5 which is wider than the external tubular element 2.

The contrast body 5 is stably connected to the internal elongated body 3 at the first end portion (anchoring length).

For the purposes of example, the connection of the contrast body 5 to the internal elongated body 3 can entail the preliminary pressing of the cable lug by way of adapted instrumentation.

The contrast body 5, chosen as a function of the type of soil, is then screwed to the cable lug, using the threaded part, and subsequently locked in place by way of a lock nut in order to prevent its accidental unscrewing.

Figure 3:
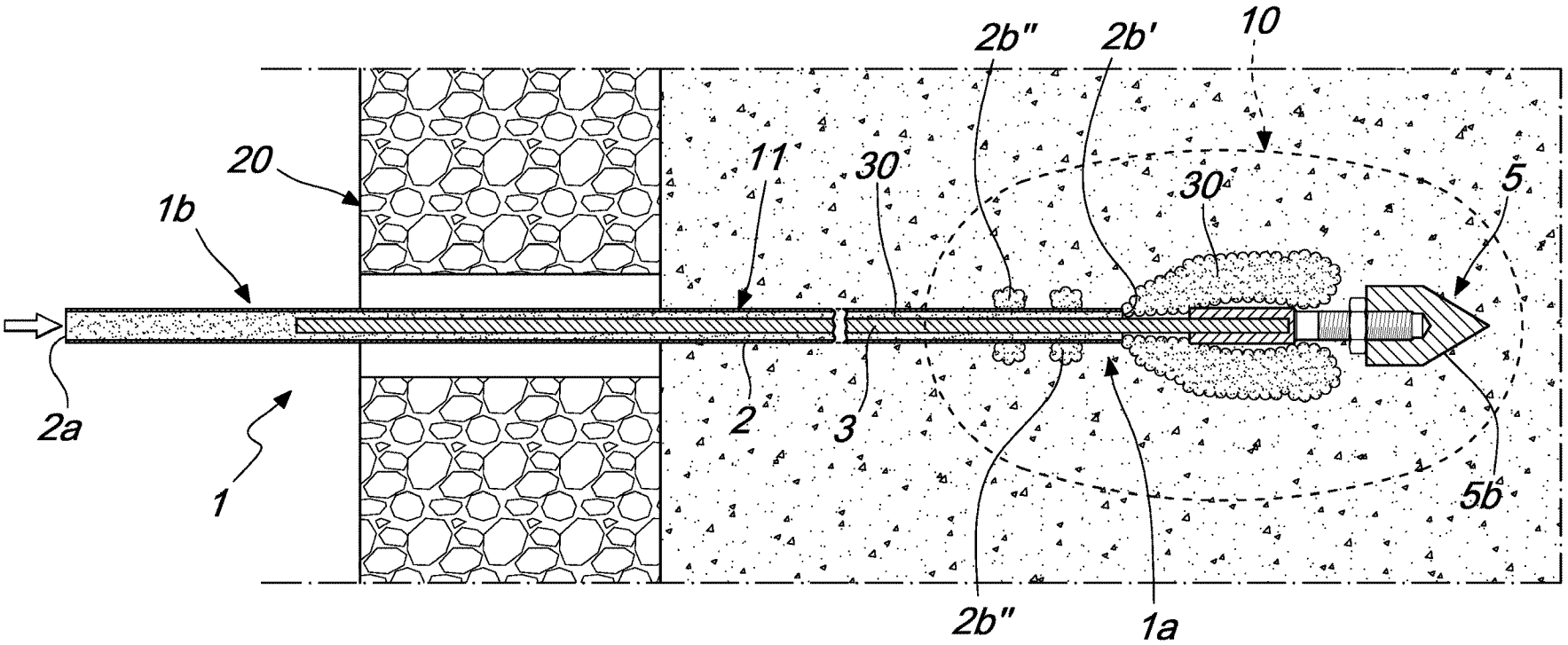
FIG. 3 shows the elongated connecting element during the injection step.
Figure 4:
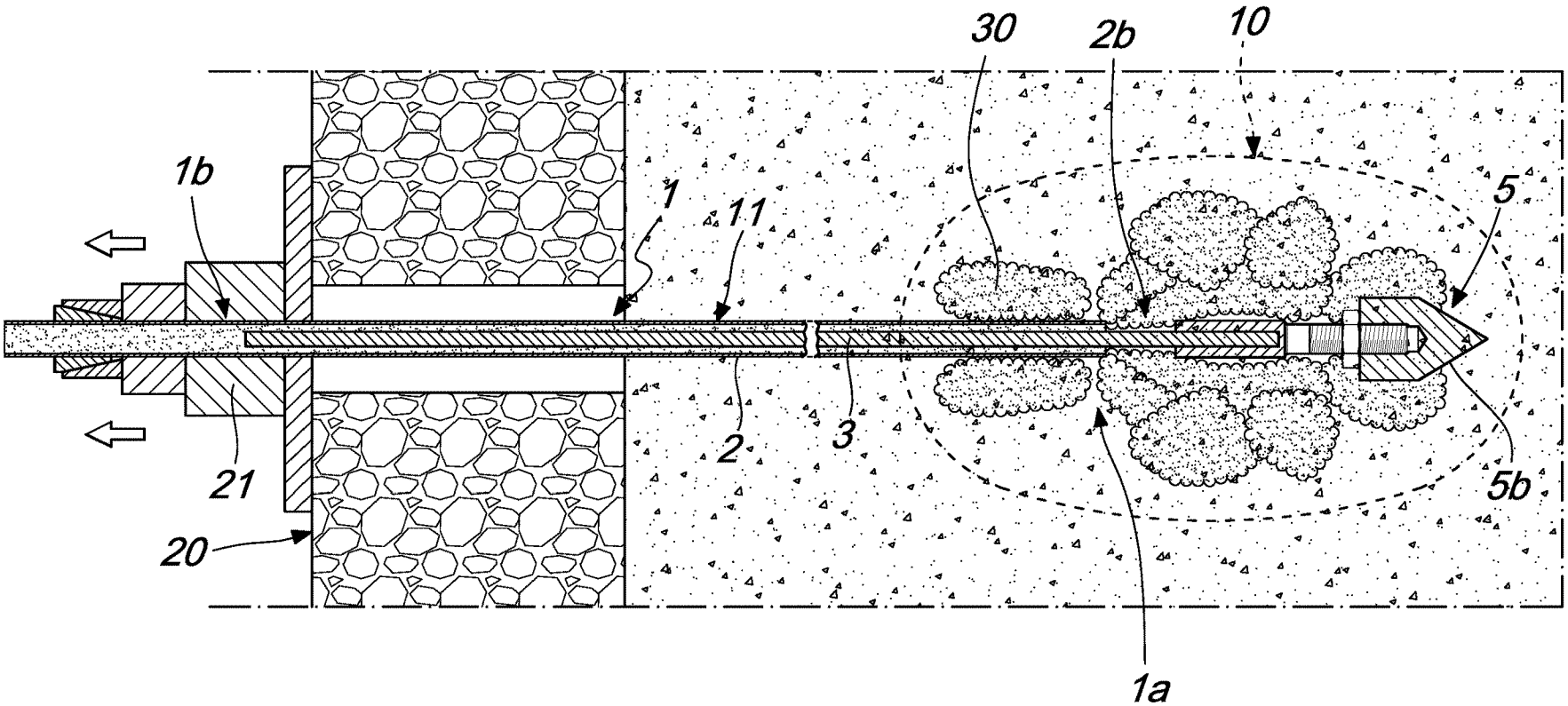
FIG. 4 shows the elongated connecting element during the tensioning step.

Conveniently, the internal elongated body 3 is axially movable with respect to the external tubular element 2 in order to move the contrast body 5 between an insertion position (shown in FIG. 1), in which it is brought closer to the first end portion of the external tubular element 2, and an injection position (shown in FIG. 3), in which it is spaced apart from the first end portion of the external tubular element 2, as a direct consequence of the partial extraction of the tubular element 2, to be performed before the injection.

According to a preferred practical embodiment, the contrast body 5 comprises an abutment portion 5*a* which faces the external tubular element 2, and a tip portion 5*b* which is arranged, in an axial direction, on the opposite end with respect to the abutment portion 5*a*.

The tip portion 5*b* is in particular designed to facilitate the insertion of the elongated connecting element 1 into the anchoring region 10.

In greater detail, the exit opening 2*b* comprises a first exit port 2*b*' which is defined between the first end portion of the external tubular element 2 and the internal elongated body 3.

Preferably, the elongated connecting element 1 is provided with further exit openings which comprise at least one lateral discharge opening 2*b*" which is defined along the extension of the external tubular element 2.

Conveniently, the feeding port 2*a* is defined between the second end portion of the external tubular element 2 and the internal elongated body 3.

Advantageously, the external tubular element 2 comprises a flexible tube.

If the elongated connecting element 1 comprises a nail, then at its head there can be at least one slit for the discharge of the synthetic anchoring mix 30 that is designed to set, penetrating at least partially into the element to be anchored 20.

The present disclosure further relates to a method for providing and installing an elongated connecting element 1 for anchoring members which is provided with a first end portion 1*a* (anchoring length), and a second end portion 1*b* (head) which lies opposite the first end portion 1*a*.

The elongated connecting element 1 comprises an external tubular element 2 which accommodates an internal elongated body 3.

The method comprises a step of inserting the first end portion 1*a* of the tension member 1 into an anchoring region 10, previously obtained by making a small-diameter hole, and a step of associating the second end portion 1*b* with a supporting element 21 which is connected to the element to be anchored 20.

The element to be anchored 20 can comprise a foundation of a building, a wall to be consolidated, a portion of rocky wall etc.

The method entails a step of injecting a synthetic anchoring mix 30 through at least one feeding port 2*a* which is defined by the external tubular element 2.

The synthetic anchoring mix 30 is designed, during the injection step, to flow through at least one exit opening 2*b* which is defined at the second end portion of the external tubular element 2.

In particular, during the injection of the synthetic anchoring mix 30 the synthetic anchoring mix 30 penetrates at least partially into the anchoring region 10 and the synthetic anchoring mix 30, once set, provides a stable connection at least between respective portions of the external tubular element 2 and of the internal elongated body 3.

The method according to the disclosure entails the use of an expanding resin as the synthetic anchoring mix 30. Use of an expanding resin determines the thickening of the volumes of soil surrounding the exit openings 2*b*, owing to the expansion of the resin, with consequent increase of the mechanical anchoring performance of the elongated connecting element. The expansion of the injected mix further determines a better adhesion of the internal body 3 to the tubular element 2, with consequent increase of the mechanical strength of the tension member or nail 1.

Conveniently, the internal elongated body 3 comprises a flexible cable.

Preferably, the method comprises the use of a contrast body 5 which is wider than the external tubular element 2 and is stably connected to the internal elongated body 3 at the first end portion.

Prior to the injection step, the element 2 is partially extracted with respect to the elongated body 3, the two elements being mutually disengaged.

During the insertion step, the contrast body 5 is arranged in an insertion position in which it is brought closer to the first end portion of the external tubular element 2 while, during the injection step, the contrast body 5 is arranged in an injection position in which it is spaced apart from the first end portion of the external tubular element 2.

In this manner, during the injection step, the contrast body 5 defines an axial barrier to the synthetic anchoring mix 30, thus ensuring a widening thereof in a radial direction, which makes it possible to obtain anchoring members that are extremely stable.

Advantageously, the contrast body 5 comprises an abutment portion 5*a* which faces the external tubular element 2, and a tip portion 5*b* which is arranged, in an axial direction, on the opposite end with respect to the abutment portion 5*a*.

The tip portion 5*b* is designed to facilitate the insertion of the elongated connecting element 1 of the anchoring region 10 during the step of insertion into the small-diameter hole made previously.

The injection step comprises the passing through, by the synthetic anchoring mix 30, of at least one exit opening 2*b* which comprises a first exit port 2*b*' which is defined between the first end portion of the external tubular element and the internal elongated body 3.

The injection step likewise comprises a step of passing through, by the synthetic mix 30, of at least one feeding port 2*a* which is defined between the second end portion of the external tubular element 2 and the internal elongated body 3.

The step of injecting an expanding synthetic mix determines an improvement of the adhesion characteristics in the anchoring region 10, owing to the thickening of the surrounding volumes of soil, a direct consequence of the pressure of expansion of the mix.

In practice it has been found that the disclosure fully achieves the intended aim and advantages by providing tension members of extremely small diameter.

The use, in order to provide the elongated connecting elements 1, of multiple flexible elements makes it possible to maintain a high overall flexibility of the elongated connecting element 1 generally, while at the same time ensuring a high strength, which is given by the sum of the strengths of the individual elements.

The flexibility and the dimensions of the elongated connecting element 1 enable a high versatility of application of the system, especially in confined spaces where it is not possible to work with rigid elements and/or cumbersome machinery, not least with regard to the dimensions of the holes to be made for inserting the tension member, generally smaller than 30 mm, which can be carried out with manual drills of reduced size.

The reduced dimensions of the elongated connecting element 1 enable its easy transport, laying, and sizing to measure, directly on the construction site.

The easy and rapid installation of the contrast body 5 makes it possible to use the one with the diameter best suited to the specific construction site, even if anomalous lithostratigraphical variations are found, or variations that differ from the design conditions.

The injection of a synthetic mix, advantageously of the expanding type, makes it possible to solve several problems at the same time:

- rapid saturation of any voids that are present;
- prevent the possibility of the injected mix being dispersed in soil volumes that are not affected by the traction forces transmitted by the tension member, hence without producing the desired effect, by virtue of the short polymerization times (when compared to cement mixes);
- thicken the surrounding soil, improving its mechanical characteristics: in fact, the greater the strength of the soil surrounding the tension member, the greater the force necessary for extracting it;
- enable the rapid provision of the tension member and the subsequent installation. In fact, if a cement mix is used, the normal setting times of the mix should be allowed to elapse prior to testing the tension member;
- obtain the adhesive bonding of the individual elements that constitute the tension member (tube+cable).

The rapid and light tensioning system makes it possible to individually check all the tension members, shortly after their provision and installation, verifying their correspondence to the design values.

The reduced dimensions make it possible to have a low invasiveness of the holes, both because of the small diameter and owing to the vibrations generated.

The disclosure, thus conceived, is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The disclosures in Italian Patent Application No. 102018000002456 from which this application claims priority are incorporated herein by reference.

The invention claimed is:

1. An elongated connecting element for anchoring members, the elongated connecting element comprising: a first anchoring end portion designed to be inserted into an anchoring region comprising a volume of soil or a portion of a wall or of a built structure, and a second end portion which defines a head, which lies opposite the first anchoring end portion and is designed to interact with an element to be anchored, comprising an external tubular element which accommodates an internal elongated body, said external tubular element defining, at said head, at least one feeding port for a synthetic anchoring mix and, at said first anchoring end portion, at least one exit opening for said synthetic anchoring mix, said synthetic anchoring mix being designed to set, penetrating at least partially into said anchoring region and creating a stable connection between said anchoring region and said elongated connecting element and between the respective portions of said external tubular element and of said internal elongated body.

2. The elongated connecting element according to claim 1, wherein the elongated connecting element comprises a tension member with said head, configured to be connected, at said head, to a supporting element which is connected stably to said element to be anchored.

3. The elongated connecting element according to claim 1, wherein said synthetic anchoring mix comprises an expanding resin.

4. The elongated connecting element according to claim 1, further comprising a contrast body that is wider than said external tubular element and is stably connected to said internal elongated body at said first end portion, said internal elongated body being axially movable with respect to said external tubular element in order to move said contrast body between an insertion position, in which said contrast body is brought closer to the first end portion of said external tubular element, and an injection position, in which said contrast body is spaced apart from the first end portion of said external tubular element.

5. The elongated connecting element according to claim 4, wherein said contrast body comprises an abutment portion facing said external tubular element, and a tip portion arranged, in an axial direction, on the opposite end with respect to said abutment portion, said tip portion being configured to facilitate the insertion of said elongated connecting element into said anchoring region.

6. The elongated connecting element according to claim 1, wherein said at least one exit opening comprises a first exit port being defined between the first end portion of said external tubular element and the internal elongated body.

7. The elongated connecting element according to claim 1, wherein said at least one exit opening comprises at least one lateral discharge opening defined along an extension of said external tubular element.

8. The elongated connecting element according to claim 1, wherein said at least one feeding port is defined between the second end portion of said external tubular element and the internal elongated body.

9. The elongated connecting element according to claim 1, wherein said external tubular element comprises a flexible tube.

10. A method for providing and installing an elongated connecting element for anchoring members, in order to anchor an element to be anchored, the elongated connecting element being provided with a first end portion and a second end portion, lying opposite the first end portion, and comprises an external tubular element which accommodates an internal elongated body, said method comprising the following steps: inserting said first end portion into an anchoring region comprising a volume of soil or a portion of a wall or of a built structure, associating said second end portion with the element to be anchored, and injecting a synthetic anchoring mix through at least one feeding port which is defined by said external tubular element, said synthetic anchoring mix being configured to flow through at least one exit opening defined at said second end portion of said external tubular element, said synthetic anchoring mix penetrating at least partially into said anchoring region, and said synthetic anchoring mix, once set, providing a stable connection between the tension member and the anchoring region and between the respective portions of said external tubular element and of said internal elongated body.

11. The method according to claim 10, wherein said synthetic anchoring mix comprises a resin of the expanding type.

12. The method according to, claim 10, wherein said internal elongated body comprises a flexible cable.

13. The method according to claim 10, further comprising a contrast body being wider than said external tubular element and stably connected to said internal elongated body at said first end portion, said internal elongated body being axially movable with respect to said external tubular element, in said insertion step said contrast body being arranged in an insertion position in which said contrast body is brought closer to the first end portion of said external tubular element, and in said injection step said contrast body being arranged in an injection position in which said contrast body is spaced apart from the first end portion of said external tubular element.

14. The method according to claim 10, wherein said contrast body comprises an abutment portion facing said external tubular element, and a tip portion arranged, in an axial direction, on an opposite end with respect to said abutment portion, said tip portion being configured to facilitate the insertion of said elongated connecting element into said anchoring region during said insertion step.

15. The method according to claim 10, wherein said injection step comprises a passing through, by said synthetic anchoring mix, of at least one exit opening which comprises a first exit port which is defined between the first end portion of said external tubular element and the internal elongated body.

16. The method according to claim 10, wherein said injection step comprises a step of passing through, by said synthetic anchoring mix, of said at least one feeding port which is defined between the second end portion of said external tubular element and the internal elongated body.

* * * * *